US007993164B2

(12) United States Patent
Chatterjee et al.

(10) Patent No.: US 7,993,164 B2
(45) Date of Patent: Aug. 9, 2011

(54) COMPACT POWER ADAPTER WITH INTERCHANGEABLE HEADS

(75) Inventors: Manjirnath Chatterjee, San Francisco, CA (US); Yoshimichi Matsuoka, Cupertino, CA (US); Peter Skillman, San Carlos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/651,402

(22) Filed: Dec. 31, 2009

(65) Prior Publication Data

US 2010/0190381 A1 Jul. 29, 2010

Related U.S. Application Data

(60) Provisional application No. 61/142,172, filed on Dec. 31, 2008.

(51) Int. Cl.
*H01R 31/06* (2006.01)

(52) U.S. Cl. ..... 439/628; 439/172; 439/651

(58) Field of Classification Search ..... 439/22, 439/172, 650, 651, 655
See application file for complete search history.

(56) References Cited

U.S. PATENT DOCUMENTS

| | | | | | |
|---|---|---|---|---|---|
| 4,364,624 | A * | 12/1982 | Williams | 439/651 |
| 5,613,863 | A * | 3/1997 | Klaus et al. | 439/131 |
| 5,744,934 | A * | 4/1998 | Wu | 320/111 |
| 5,766,020 | A * | 6/1998 | Hughes | 439/35 |
| 5,997,310 | A * | 12/1999 | Chiu et al. | 439/21 |
| 6,328,581 | B1 * | 12/2001 | Lee et al. | 439/106 |
| 6,669,495 | B2 * | 12/2003 | Philips et al. | 439/170 |
| 6,923,667 | B1 * | 8/2005 | Chen | 439/172 |
| 6,942,508 | B2 * | 9/2005 | Wong | 439/171 |
| 7,632,137 | B1 * | 12/2009 | Ma et al. | 439/518 |
| 2002/0127918 | A1 * | 9/2002 | Kajiwara et al. | 439/651 |
| 2004/0110397 | A1 * | 6/2004 | Chen | 439/75 |
| 2008/0139050 | A1 * | 6/2008 | Liao | 439/651 |
| 2009/0325422 | A1 * | 12/2009 | Ooi | 439/638 |

OTHER PUBLICATIONS

U.S. Appl. No. 29/323,686, filed Aug. 28, 2008, Matsuoka et al.

* cited by examiner

*Primary Examiner* — Briggitte R Hammond

*Assistant Examiner* — Larisa Z Tsukerman

(74) *Attorney, Agent, or Firm* — Mahamedi Paradice Kreisman LLP; Van Mahamedi

(57) ABSTRACT

A power adapter for extending power from an electrical power source to a electrical device. The power adapter includes an adapter body, including an exchange surface, having one or more sets of interior electrical contacts. The power adapter further includes an end section that is attachable and detachable from the body. The end section includes (i) a set of end section interior electrical contact elements that make contact with the at least one set of interior electrical contacts, and (ii) a plug connector, electrically connected to the set of end section interior electrical contacts, and adapted to mate with a corresponding electrical receptacle.

17 Claims, 6 Drawing Sheets

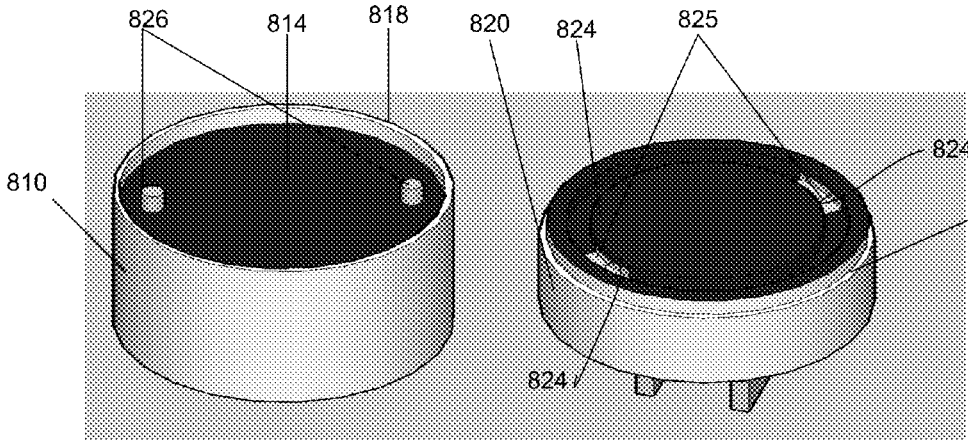
FIG. 8A
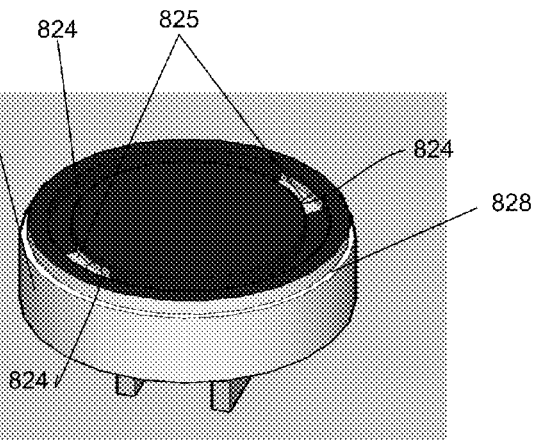
FIG. 8B
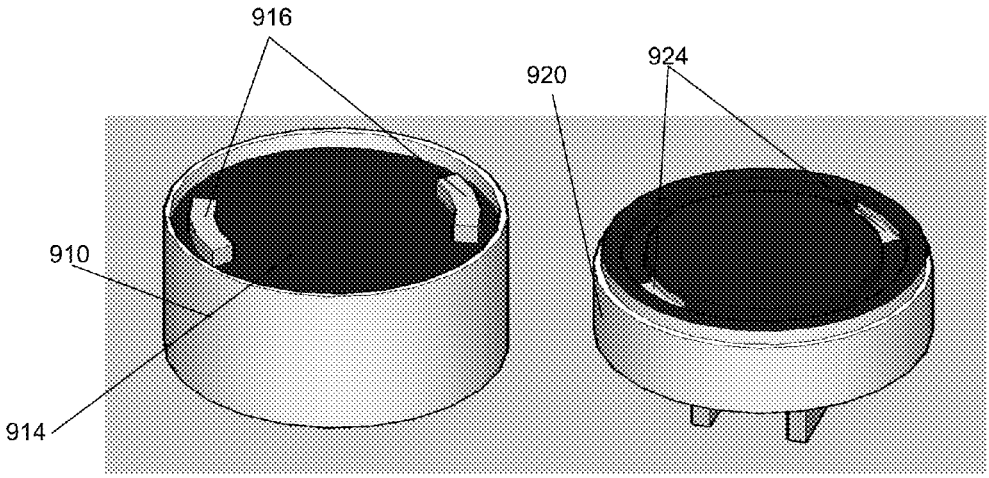
FIG. 9A
FIG. 9B

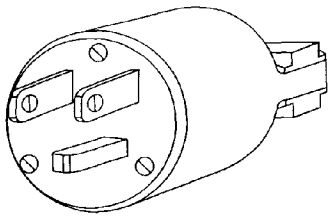
North America
(950W power supply)
NEMA 5-15 plug (15A)
FIG. 12A
(PRIOR ART)
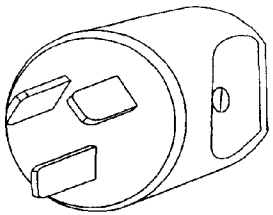
Australia, New Zealand
SAA/3 plug
AS/NZZS 3112-1993 (10A)
FIG. 12B
(PRIOR ART)
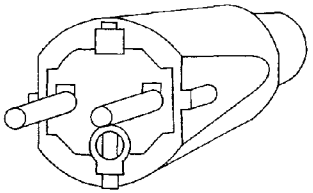
Europe
VING plug
CEE (7) VII (10A)
FIG. 12C
(PRIOR ART)
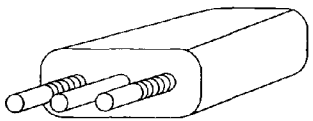
Italy
1/3/16 plug
CEI 23-16 (10A)
FIG. 12D
(PRIOR ART)
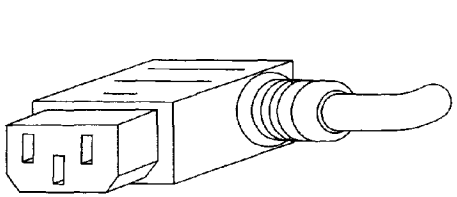
United Kingdom
BS89/13
BS 1363/A
(10A: replaceable fuse)
FIG. 12E
(PRIOR ART)
Appliance coupler
C15W coupler
EN60320 (15A)
FIG. 12F
(PRIOR ART)
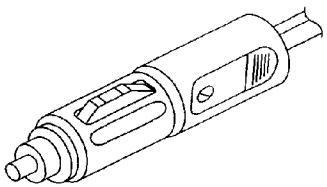
DC Plugs
12-24V
FIG. 13
(PRIOR ART)

COMPACT POWER ADAPTER WITH INTERCHANGEABLE HEADS

RELATED APPLICATIONS

This application claims priority to U.S. Provisional Patent Application No. 61/142,172, filed Dec. 31, 2008, and entitled "Compact Power Adapter with Interchangeable Heads," which is hereby incorporated by reference in its entirety.

This application also hereby incorporates by reference, in its entirety, U.S. Design application Ser. No. 29/323,686, filed Aug. 28, 2008.

TECHNICAL FIELD

The disclosed embodiments relate to power adapters for electronic devices, and more specifically to a compact power adapter with interchangeable heads.

BACKGROUND

Wall adapters (sometimes referred to as 'wall warts') extend power from wall outlets to electronic devices. There are numerous types of wall adapters, to suit different types of outlets or purpose. Domestic wall outlets, for example, are receptacles that provide power in the range of 110-120 volts at 60 Hz. Non-domestic outlets may vary the voltage between, for example, 90-240 volts, at frequencies that range between 50-60 Hz. Car chargers and other DC power sources typically accept plugs and supply power at between 12-14 volts. FIG. 12A through FIG. 12E illustrates numerous types of prior art adapters for AC outlets, including domestic AC outlets (FIG. 12A) and non-domestic outlets (FIG. 12B through FIG. 12E). FIG. 13 illustrates a standard, prior art DC plug adapter, such as used for automobile power outlets.

BRIEF DESCRIPTION OF THE DRAWINGS

FIG. 8A and FIG. 8B illustrate a power adapter combination assembly that utilizes a peg and groove lock connection mechanism for enabling detachable connection of an end section to an adapter body.

FIG. 9A and FIG. 9B illustrates a variation to an embodiment of FIG. 8A and FIG. 8B.

FIG. 12A through FIG. 12F illustrates numerous types of prior art adapters for AC outlets.

FIG. 13 illustrates a standard, prior art DC plug adapter, such as used for automobile power outlets.

DETAILED DESCRIPTION

According to embodiments, a power adapter is provided for a electrical device. The power adapter may include an adapter body and end section, where the end section can detach and reattach to the adapter body. The power adapter may be used to power or charge electrical devices, such as a mobile electrical device (e.g. wireless telephony/messaging device), portable computers (e.g. netbooks, laptops), portable media player, global positioning system (GPS) device, cameras and/or video recorders.

Embodiments described herein include a power adapter for extending power from an electrical power source to a electrical device. The power adapter includes an adapter body, including an exchange surface, having one or more sets of interior electrical contacts. The power adapter further includes an end section that is attachable and detachable from the body. The end section includes (i) a set of end section interior electrical contact elements that make contact with the at least one set of interior electrical contacts, and (ii) a plug connector, electrically connected to the set of end section interior electrical contacts, and adapted to mate with a corresponding electrical receptacle.

According to some embodiments, the adapter body includes unified electronics for handing both an incoming alternating current (AC) power signal and a direct current (DC) source.

According to some embodiments, a power adapter is provided for extending power from an electrical power source to a electrical device. The power adapter includes an adapter body structured to detachably receive any one of a plurality of end sections. Each end section including a plug interface for a particular type of electrical receptacle.

Still further, an embodiment includes a power adapter that includes a cylindrical adapter body, and an end section including a plug connector.

Figure 1:
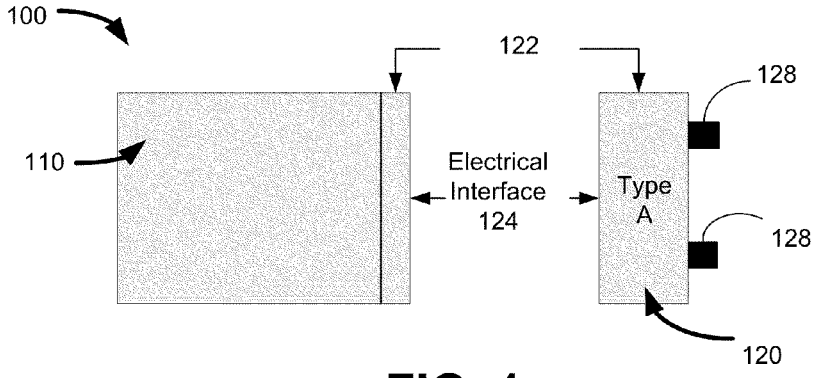
FIG. 1 illustrates a power adapter, according to embodiments.

FIG. 1 illustrates a power adapter, according to embodiments. An adapter 100 includes an adapter body 110 and an end section 120 (or head). As described by numerous embodiments, a user can detach the end section 120 and swap a different end section of a different type onto the adapter body 110. The adapter body 110 and end section 120 each include one or more mechanical attachment structures 122 to enable the end section to mechanically attach and detach from the adapter body 120. The adapter body 110 also includes an electrical interface 124 that enables the adapter body to form an electrical connection with different types of end sections, including, for example, DC plugs and non-domestic (e.g. European standard) AC plugs. The electrical connection formed between the adapter body 110 and end section 120 enables electrical power to extend from a power source (e.g.

outlet) to a electrical device that is attached to receive power from the power adapter 100. The end section 120 includes an outlet interface (as shown by tongs 128) for a particular type of outlet (e.g. wall outlet (domestic or international), car charger etc.). The user can detach end section 120 (e.g. domestic electrical outlet AC plug) from the adapter body 120 and attach a different end section (e.g. DC plug for automobile plug).

Thus, for example, according to some embodiments, the user attaches one kind of end section 120 onto the adapter body 110 in order to mate and receive power from a wall outlet. The user can replace the wall outlet end section for another end section that can mate with a power port (e.g. "cigarette lighter) of an automobile. As the example illustrates, such embodiments allow the user to use the same adapter body 110 and cord, rather than having to replace the entire power adapter for different charging environments.

Figure 2A:
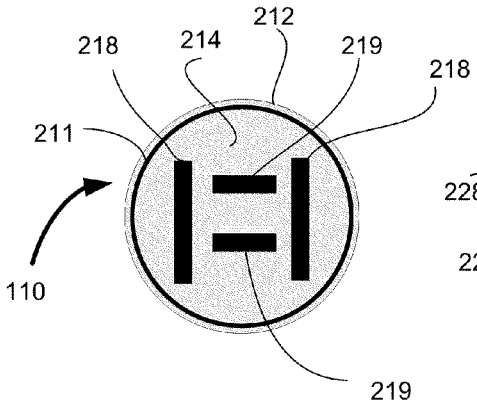
FIG. 2A and FIG. 2B illustrate end views of the respective mating sections of an adapter and an end section, such as shown by FIG. 1, according to embodiments.
Figure 2B:
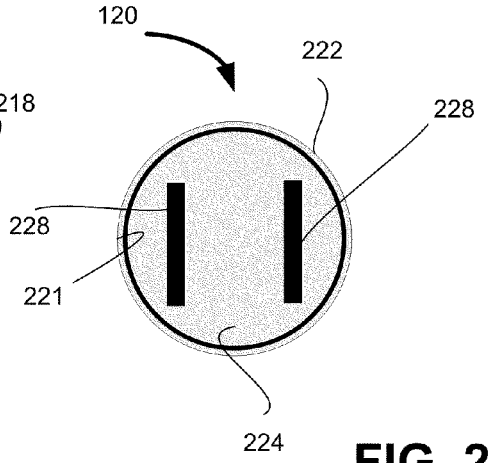

FIG. 2A and FIG. 2B illustrate end views of the respective mating surfaces of the adapter 110 and the end section 120, under an embodiment. With reference to FIG. 2A, the adapter body 110 includes a perimeter wall 212 having an interior exchange surface 214. In one embodiment, multiple sets of interior electrical contacts 218, 219 are provided on the exchange surface 214 of the adapter body 110. Each set of electrical contacts 218, 219 are for a particular type of end section 120. Specific examples of types of end sections include (i) domestic AC wall outlet (e.g. 100-120V/60 Hz; see e.g. FIG. 12A), (ii) non-domestic AC wall outlet (e.g. 220-240V at 50 Hz; see e.g. FIG. 12B-12E), and (iii) DC outlet (e.g. 12V automobile adapter; e.g. see FIG. 13).

With reference to FIG. 2B, end section 120 includes a perimeter wall 222 and an interior mating surface 224. The interior mating surface 224 includes a corresponding set of interior electrical contacts 228 that are aligned to mate with one of the sets of electrical contacts 218 on the exchange surface 214 of the adapter body 210.

In an embodiment, end section 120 attaches to the adapter body 110 through a threaded twist-on and twist-off mechanisms. The perimeter wall 212 of the adapter body 110 includes thread structures 211, dimensioned to mate with corresponding thread structures 221 on the perimeter wall 222 of the end section 220. In this way, the end section 120 and adapter body 110 are able to attach and detach, and form an electrical connection when attached, so as to enable power to be extended from a power source to the adapter body 110. As described with other embodiments, the adapter body 110 includes unified electronics to enable treatment of power from various types of sources.

Figure 3A:
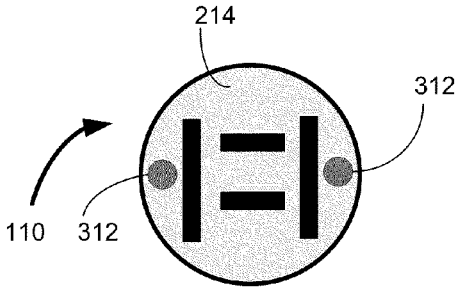
FIG. 3A and FIG. 3B illustrate an alternative mechanical coupling structure for a power adapter assembly, in accordance with some embodiments.
Figure 3B:
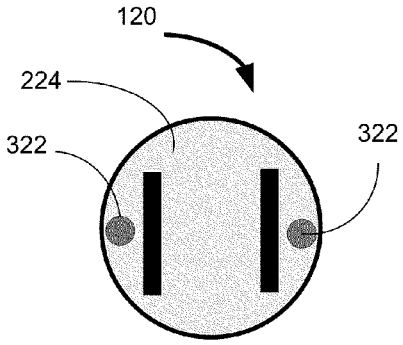

FIG. 3A and FIG. 3B illustrate an alternative mechanical coupling structure for a power adapter assembly, in accordance with some embodiments. FIG. 3A and FIG. 3B are alternative end views of the respective mating sections of the adapter 110 and the end section 120. Rather than use threads, a mechanical clasping mechanism serves as the attachment mechanisms for coupling the adapter body 110 and end section 120. In one implementation, exchange surface 214 of the adapter body 110 includes the sets of electrical contacts 218, 219, as well as one or more clasp members 312 that extend from the exchange surface 214. The interior mating surface 224 of the end section 220 includes apertures 322 that are positioned and dimensioned to receive the clasp members 312. The clasp members 312 bias and engage the apertures 322 to lock the end section 120 in place. Electrical contacts 228 on the end section 120 are then brought into contact with a corresponding set of electrical contacts 218 on the adapter body 110. Other end sections 120 may be mated to the adapter body 110 that use the alternative set of electrical contacts 219 on the adapter body 110. Numerous clasp variations may be implemented, including providing additional or alternative clasps on the end section 120, to mate with apertures on the adapter body 110.

With reference to embodiments described above, the adapter body 110 may include unified electronics for enabling the adapter body to regulate and optionally convert an incoming power supply for the load (i.e. the interconnected electronic device). In one embodiment, the unified electronics includes (i) AC to DC conversion circuits and elements that convert an alternating input of various voltage ranges and frequencies (e.g. domestic and international outlets-e.g. 90-250 v; 50-60 Hz) into a DC signal; (ii) DC regulation circuits, to buck, boost or otherwise regulate incoming DC power signal (e.g. 12-24 volts) and output DC. As an alternative or variation, the unified electronics may act as an invertor, transforming an incoming DC signal into an AC output.

Figure 4:
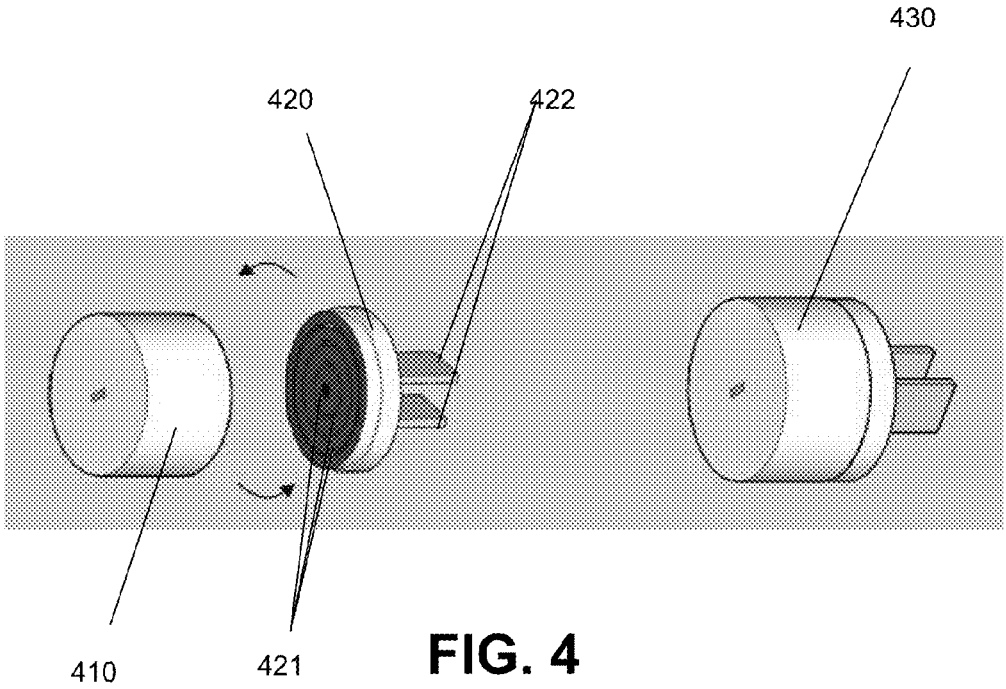
FIG. 4 illustrates an adapter formed by an adapter body and an end section, according to another embodiment.

FIG.4 illustrates an adapter formed by an adapter body and an end section, according to another embodiment. The adapter body 410 is structured to (detachably) attach to an end section 420 to form an assembled adapter 430. The end section 420 includes a receptacle connector 422 (e.g. pair of spaced tongs) for a wall outlet, making the assembled adapter 430 a power adapter for such an outlet. The adapter body 410 includes unified electronics to enable different types of end sections 420 to be utilized.

In the embodiment shown, a twist-on mechanical coupling is used. An electric interface comprises a concentric ring arrangement of electrical contacts. Each ring 421 is radially positioned to make electrical contact with a corresponding electrical contact of the adapter body 410. Alternatively, the electrical interface of the adapter body 410 and end section 420 is provided in multiple sets of blades that are positioned to meet corresponding blades or elements of the end section. Each set of blades may be positioned for a corresponding type of end section.

Figure 5:
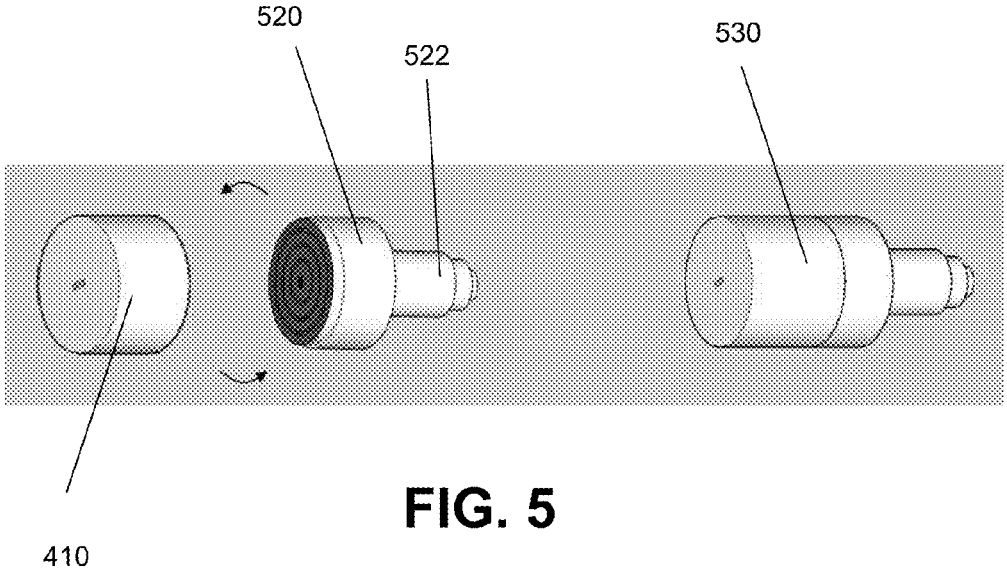
FIG. 5 illustrates a DC plug end section for attachment to an adapter body, according to an embodiment.

In FIG. 5, adapter body 410 connects to an end section 520 that is a plug connector 522 for a DC power source (e.g. car charger). The assembled adapter 530 becomes a power adapter for such a power source. As illustrated by FIG. 4 and FIG. 5, same adapter body 410 thus can mate with end sections corresponding to the receptacle plug (FIG. 4) and DC source (FIG. 5).

Figures 6A, 6B, 6C:
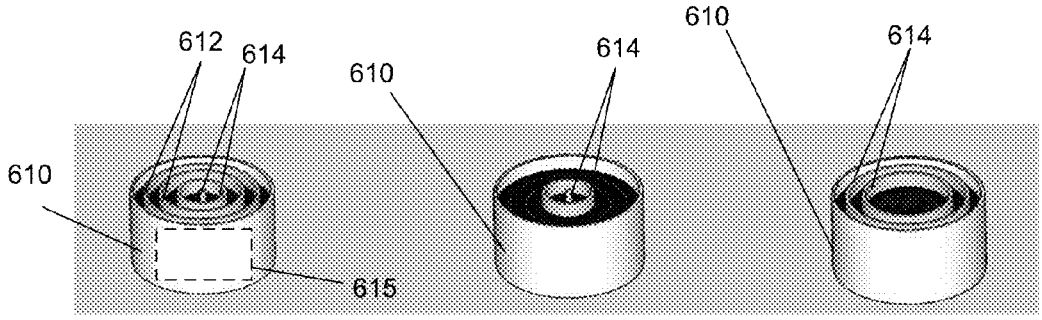
FIG. 6A through FIG. 6C illustrate variations to an adapter body, according to some embodiments.

FIG. 6A through FIG. 6C illustrate variations to an adapter body, according to some embodiments. An embodiment such as shown in FIG. 6A through FIG. 6C illustrate an electrical interface on the adapter body 610 that has a ring electrode configuration. In other implementations, other electrode configurations may be used (e.g. blades, pins or other contact structures and geometries). In an embodiment of FIG. 6A, an adapter body 610 includes multiple sets of electrodes or contact elements 612, 614, with each set being aligned to make contact with corresponding contact elements of a particular type or types of end sections. In FIG. 6A, the adapter body 610 includes (i) a set of electrodes 612 for an end section that mates with an AC outlet; (ii) a second set of electrodes 614 for an end section that mates with DC receptacle. Each set of electrode 612, 614 is aligned and positioned to make contact with a corresponding set of electrodes for a particular kind of end section. The adapter body 610 has unified electronics 615 (represented in phantom), allowing the AC source to range between, for example, 90-250V and 50-60 Hz, and the DC source to range between, for example, 12-24 volts.

With reference to FIG. 6B, a variation is shown in which the adapter body 610 includes electrodes only for an AC source or outlet. In such an embodiment, the adapter body 610 includes electronics for receiving and converting AC inputs of varying voltages and frequencies (e.g. 90-250V, 50-60 Hz), so as to be matable with end sections for different kinds of AC outlets.

In FIG. 6C, another variation is shown in which the adapter body 610 includes electrodes 614 that are positioned to mate with end sections that are DC sources.

Figures 7A, 7B, 7C:
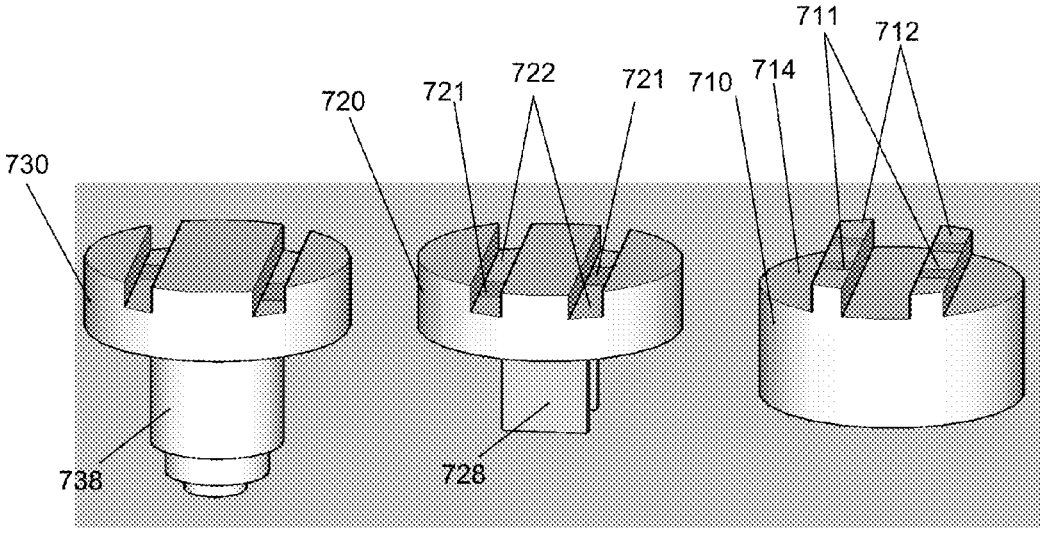
FIG. 7A illustrates an adapter body for forming a power adapter combination that utilizes a slide locking mechanism, according to an embodiment.
FIG. 7B illustrates a type of end section that can be mated with the adapter body of FIG. 7A.
FIG. 7C illustrates another kind of end section that can be mated with the adapter body of FIG. 7A.

Some embodiments include adapter body and end section combinations that integrate mechanical and electrical attachment interfaces. FIG. 7A through FIG. 7C illustrates a power adapter combination assembly that utilizes a slide locking mechanism, according to one embodiment. In FIG. 7A, adapter body 710 includes raised structures 712 that extend from an exchange surface 714. The raised structures include a set of contact elements 711. The raised structures 712 are dimensioned and shaped to be received by receptacle structures formed on end sections for the adapter body. FIG. 7B illustrates a first type of end section 720 that includes receptacle structures 722 for receiving the raised structures. As shown, the end section 720 is a wall outlet plug including the tongs 728. A set of contact elements 721 make contact with the set of contact elements on the adapter body 710. The physical mating structure, as provided by the raised structures 712 and the receptacle structures 722, thus integrate electrical connectivity between the two end pieces. The two pieces depicted in FIG. 7A and FIG. 7B can be slide-locked into place (meaning the raised structures 712 slide into the receptacle structures 722), using, for example, a friction fit to retain the two pieces in position. When retained, the respective electrical contact elements 711 and 721 form the electrical connection.

FIG. 7C illustrates another kind of end section that can be mated with the adapter body of FIG. 7A. The end section 730 provides a DC plug connector, but has a similar receptacle structure as that shown with the end section of FIG. 7B. But end section 730 includes the DC plug 738 for mating with, for example, a car charger receptacle.

FIG. 8A and FIG. 8B illustrate a power adapter combination assembly that utilizes a peg and groove lock connection mechanism for enabling detachable connection of an end section to an adapter body. In the implementation shown, adapter body 810 includes an exchange surface 814 from which raised, conductive contact elements 816 extend. The end section 820 includes a platform 824 that receives the exchange surface 814 of the adapter body 810. The platform 824 includes openings 824 that expose contact pads or layer 825. The adapter body 810 is placed over the end section 820, so that the perimeter wall 818 of the adapter body is received by a perimeter groove 828 on the end section 820. With the perimeter wall 818 and groove 828 engaged, adapter body 810 is twisted, so that the contact elements 816 of the adapter body 810 engage and lock into the openings 824 the platform 824, creating electrical connection between pads 825 and the contact elements 816.

FIG. 9A and FIG. 9B illustrates a variation to an embodiment of FIG. 8A and FIG. 8B. In FIG. 9A and FIG. 9B, raised contact elements 916 extend from exchange surface 914. Rather than form pin formations, the contact elements 916 are arc shaped. In one variation, the contact elements 916 are shaped for polarization. The end section 920 includes openings 924 that are shaped to receive the contact elements 916. Contact pads 925 or elements may underlie the openings 924, to enable the electrical formation to be created.

With regard to embodiments of FIG. 8A-FIG. 8B and FIG. 9A-FIG. 9B, alternative configurations may provide for male (protruding) structures to extend from the end sections 820, 920 to be received by apertures on the adapter bodies 810, 910, respectively. Additionally, different types of end sections may be used to mate with an adapter body.

Figure 10:
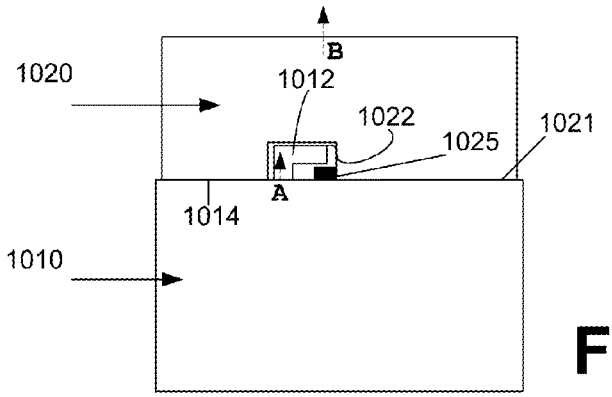
FIG. 10 illustrates another variation in which a power adapter includes a lock and slide connection, under an embodiment.

FIG. 10 illustrates another variation in which a power adapter includes a lock and slide connection, under an embodiment. According to some embodiments, one of either the adapter body 1010 or end section 1020 include a biased male late member, while the other component includes an aperture for receiving the biased element. In the configuration shown, a male biased latch member 1012 extends from the adapter body 1010 to engage the opening 1022 of the end section 1020. When a twist motion is applied, an underside of the end section 1021 forces the latch member 1022 down into the exchange surface 1014 of the adapter body (see A). At the same time, the user applies a twist motion (see B) that moves the opening 1022 over the latch member 1012. Without obstruction, latch member 1012 extends into the opening and releases, causing the latch member to be extended in the opening. With further twisting, obstruction 1025 formed in the end section 1020 locks the latch member 1012 in place. The adapter body 1010 and end section 1020 are mechanically locked to form the power assembly. An electrical interface between the two components may be implemented as described above. To unlock, the user may reverse the twist direction while pressing the end section 1020 down, causing the latch member 1012 to bias when it is again aligned in to the opening to have no obstruction. This allows the end section 1020 to be detached from the adapter body 1010.

Figure 11A:
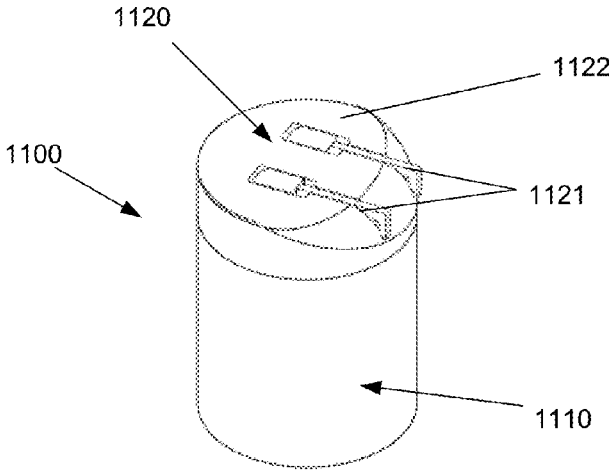
FIG. 11A illustrates a power adapter assembly, according to embodiments.
Figure 11B:
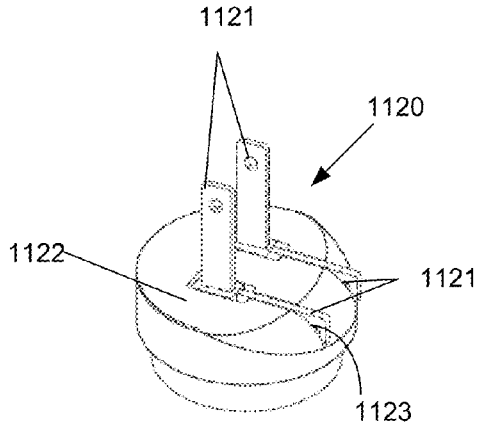
FIG. 11B is a side isometric view of a receptacle interface surface for a power adapter, under an embodiment.
Figure 11C:
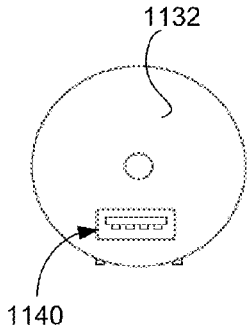
FIG. 11C illustrates am end face for a power adapter, under an embodiment.

FIG. 11A through FIG. 11C illustrate a power adapter assembly, under an embodiment. A power adapter assembly 1100 includes adapter body 1110 and end section 1120. As described with prior embodiments, the end section 1120 may be detachable from the adapter body 1110. In some embodiments, the adapter assembly 1100 is cylindrical, and dimensioned so that it can be inserted into an outlet without blocking access to an adjacent outlet. In this regard, embodiments recognize the advantage of using a rounded or circular cross-section to reduce the profile of the power adapter assembly when it is plugged into a wall. In one embodiment, a receptacle interface surface 1122 of the assembly 1000 includes retractable tongs 1121.

FIG. 11B is a side isometric view of the receptacle interface surface 1122. The tongs 1121 are shown in both the extended and retracted position. In the retracted position, the tongs 1121 are positioned in the openings or slots 1123 formed into the interface surface 1122. In the extended position, the tongs 1121 extend substantially orthogonally from the interface surface 1122. In one embodiment, the tongs 1121 pivot down, and can lie in the slots 1123 to be substantially flush or beneath the interface surface 1122.

A cord may connect to the power adapter assembly in order to enable the power adapter to extend power to a connected device. FIG. 11C illustrates that the adapter body 1110 includes an end face 1132 that provides a connector 1140 for receiving the cord (not shown). In one implementation, the connector 1140 is a receptacle connector, such as a standard USB connector. In variations, an alternative connector type may be used (e.g. Magsafe connector), or the connector may be replace with a cord or wired extension.

Figure 11D:
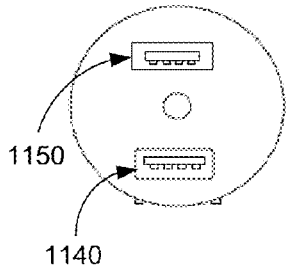
FIG. 11D illustrates use of a second USB or receptacle connector, under another embodiment.

FIG. 11D illustrates use of a second USB or receptacle connector. In one usage scenario, the first receptacle connector 1140 receives a plug connector attached to a cord that extends to a mobile computing device. A second receptacle connector 1150 can be similarly used to charge, for example, an accessory device of the computing device (e.g. wireless headset), or alternatively a second computing device. While FIG. 11D illustrates the use of two USB type connectors, other implementations may use other outlets or connectors.

For example, one or both connectors may correspond to a MagSafe connector, or as an alternative to use of a connector, one or more both connectors may include cords or wired extensions for connection to other computing device.

In one embodiment, the end face 1132 includes multiple connectors, or otherwise provides for receiving more than one cord. Each received cord may power or charge a different device. For example, each received cord my power a mobile computing (or other electrical) device and a wireless headset for the device.

It is contemplated for embodiments described herein to extend to individual elements and concepts described herein, independently of other concepts, ideas or system, as well as for embodiments to include combinations of elements recited anywhere in this application. Although illustrative embodiments of the invention have been described in detail herein with reference to the accompanying drawings, it is to be understood that the invention is not limited to those precise embodiments. As such, many modifications and variations will be apparent to practitioners skilled in this art. Accordingly, it is intended that the scope of the invention be defined by the following claims and their equivalents. Furthermore, it is contemplated that a particular feature described either individually or as part of an embodiment can be combined with other individually described features, or parts of other embodiments, even if the other features and embodiments make no mentioned of the particular feature. This, the absence of describing combinations should not preclude the inventor from claiming rights to such combinations.

What is claimed is:

1. A power adapter for extending power from an electrical power source to a electrical device, the power adapter comprising:

a cylindrical adapter body including an exchange surface having one or more sets of interior electrical contacts;

an end section that is attachable and detachable from the body, the end section including (i) a set of end section interior electrical contacts that make contact with the at least one set of interior electrical contacts, and (ii) a plug connector, electrically connected to the set of end section interior electrical contacts, and adapted to mate with a corresponding electrical receptacle; and wherein the adapter body includes an end face that is opposite to the end section, and wherein the end face includes a female receptacle connector to receive a cord with a corresponding plug connector.

2. The power adapter of claim 1, wherein the adapter body includes unified electronics for handing both an incoming alternating current (AC) power signal and a direct current (DC) source.

3. The power adapter of claim 1, wherein each of the adapter body and the end section are structured to enable the end section to twist on and twist off the adapter body.

4. The power adapter of claim 1, wherein each of the adapter body and the end section includes clasps to enable the end section to attach and detach from the adapter body.

5. The power adapter of claim 1, wherein the one or more sets of interior electrical contacts include a set of concentric rings.

6. The power adapter of claim 1, the one or more sets of interior electrical contacts include a set of blades or prongs.

7. A power adapter for extending power from an electrical power source to a electrical device, the power adapter comprising:

a cylindrical adapter body structured to detachably receive any one of a plurality of end sections, each end section including a plug interface for a particular type of electrical receptacle; and wherein the adapter body includes an end face that is opposite to the end section, and wherein the end face includes a female receptacle connector to receive a cord with a corresponding plug connector.

8. The power adapter of claim 7, wherein the adapter body is structured to detachably receive each of (i) a first end section that includes a first type of plug interface for a wall outlet, and (ii) a second end section that includes a second type of plug interface for a direct current outlet.

9. The power adapter of claim 7, wherein the adapter body is structured to detachably receive a third end section includes a second type of plug interface for a non-domestic wall outlet.

10. The power adapter of claim 7, wherein the adapter body includes a perimeter wall that has a threaded surface to receive each of the plurality of end sections through a twist on connection.

11. The power adapter of claim 7, wherein the adapter body includes clasps to engage and retain each of the plurality of end sections.

12. The power adapter of claim 7, wherein the adapter body includes one or more sets of interior electrical contacts that electrical mater with corresponding contacts each of the plurality of extensions, and wherein the one or more sets of interior electrical contacts have a concentric ring arrangement.

13. The power adapter of claim 7, wherein the adapter body includes one or more sets of interior electrical contacts that electrical mater with corresponding contacts each of the plurality of extensions, and wherein the one or more sets of interior electrical contacts have a blade arrangement.

14. A power adapter for extending power from an electrical power source to a electrical device, the power adapter comprising:

an adapter body;

an end section including a plug connector;

wherein the adapter body is cylindrical; and wherein the cylindrical adapter body includes an end face that is opposite to the end section, and wherein the end face includes a female receptacle connector to receive a cord with a corresponding plug connector.

15. The power adapter of claim 14, wherein the plug connector is retractable into the end section.

16. The power adapter of claim 14, wherein the end section is attachable and detachable from the adapter body.

17. The power adapter of claim 14, wherein the end face includes a second female receptacle connector to receive a second plug connector.

* * * * *

UNITED STATES PATENT AND TRADEMARK OFFICE

CERTIFICATE OF CORRECTION

PATENT NO. : 7,993,164 B2
APPLICATION NO. : 12/651402
DATED : August 9, 2011
INVENTOR(S) : Manjirnath Chatterjee et al.

It is certified that error appears in the above-identified patent and that said Letters Patent is hereby corrected as shown below:

In column 8, line 4, in Claim 6, delete “the” and insert -- wherein the --, therefor.

Signed and Sealed this
Third Day of April, 2012

David J. Kappos

David J. Kappos
*Director of the United States Patent and Trademark Office*